US005829178A

United States Patent [19]

Hillstrom

[11] Patent Number: 5,829,178

[45] Date of Patent: Nov. 3, 1998

[54] PORTABLE COLLAPSIBLE SIGN AND STAND

[75] Inventor: David U. Hillstrom, Novi, Mich.

[73] Assignee: Marketing Displays, Inc., Farmington Hills, Mich.

[21] Appl. No.: 759,466

[22] Filed: Dec. 5, 1996

[51] Int. Cl.[6] ..... G09F 15/00

[52] U.S. Cl. ..... 40/610; 40/612; 248/170

[58] Field of Search ..... 40/606, 610, 612; 248/166, 170, 176.1, 188.7

[56] References Cited

U.S. PATENT DOCUMENTS

| | | | |
|---|---|---|---|
| 2,732,823 | 1/1956 | Hanson | 116/173 |
| 2,887,983 | 5/1959 | Budd | 116/63 |
| 3,526,200 | 9/1970 | Doyle | 116/63 |
| 3,847,335 | 11/1974 | Ross | 248/166 |
| 3,899,843 | 8/1975 | Doyle et al. | 40/612 X |
| 4,507,887 | 4/1985 | Seely | 40/606 |
| 4,541,190 | 9/1985 | Weiner et al. | 40/610 |
| 4,592,158 | 6/1986 | Seely | 40/603 |
| 4,593,879 | 6/1986 | Seeley et al. | 248/624 |
| 4,619,220 | 10/1986 | Seely et al. | 116/63 |
| 4,694,601 | 9/1987 | Dicke et al. | 40/610 |
| 4,817,319 | 4/1989 | Vitale | 40/610 |
| 4,863,138 | 9/1989 | Dicke et al. | 248/170 X |
| 4,866,866 | 9/1989 | Rotter et al. | 40/610 |
| 4,875,302 | 10/1989 | Noffsinger | 40/610 |
| 4,980,984 | 1/1991 | Kulp et al. | 40/610 |
| 5,152,091 | 10/1992 | Leach | 40/603 |
| 5,276,424 | 1/1994 | Hegemann | 340/321 |
| 5,340,068 | 8/1994 | Sarkisian et al. | 248/188.6 |
| 5,540,007 | 7/1996 | Kulp et al. | 40/610 |
| 5,611,509 | 3/1997 | Kulp et al. | 248/188.7 |

FOREIGN PATENT DOCUMENTS

| | | | |
|---|---|---|---|
| 9110986 | 7/1991 | WIPO | 40/610 |

OTHER PUBLICATIONS

Dicke Tool Company, "Safety Equipment and Tools for the Next Century and Beyond", 1993 (Cover sheet, pp. 12–13, back page).

*Primary Examiner*—Brian K. Green

[57] ABSTRACT

A collapsible sign member is attached to a collapsible base member and the two members can be disassembled and folded-up into a compact package for storage and transport. Horizontal cross-brace members for the sign member are connected to a central bracket member which is releasably attached to a vertical upright member in the base member. Another cross-brace member is slidably received in the vertical upright member. A sign panel is connected to the ends of horizontal and vertical cross-brace members and the vertical upright member in order to be fully displayed for viewing by passing motorists and pedestrians. A foldable flag mechanism is used to display a set of warning flags. The flag mechanism is pivotally attached to the vertical cross-brace member. The combination sign and sign stand assembly can be quickly and readily assembled to its display condition and, correspondingly, disassembled and folded-up to its storage and transport condition.

17 Claims, 5 Drawing Sheets

PORTABLE COLLAPSIBLE SIGN AND STAND

TECHNICAL FIELD

A portable collapsible combination sign and stand device is disclosed, particularly for use in traffic control situations.

BACKGROUND OF THE INVENTION

There is a need along public highways and pedestrian walkways for signs to provide notices and information to the public, particularly along construction sites. These construction sites include highway construction, commercial building construction, utility work sites, and the like. These signs provide notice and information to the passing public, particularly for those in vehicles, and thus are typically called "traffic control signs". In addition, warning flags are often provided for attachment to the sign or sign stand.

Frequently, the need for the signs is temporary and it is advantageous to have signs which may be readily assembled and disassembled. At the same time, it is necessary for the signs to be durable and resistant to such factors as weather conditions, high winds, wind currents generated by passing vehicles, and rough handling. In order to be portable and collapsible, the signs normally include a flexible roll-up sign panel connected to a collapsing cross-brace framework, together with a sign stand with foldable and extendable legs. Sign and sign stand combinations of this type are currently available, for example, from Marketing Displays, Inc. and marketed under the names WindMaster, TrafficMaster, and System 3. Some of these systems are shown, for example, in U.S. Pat. Nos. 4,592,158, 4,593,879, 4,619,220 and 5,340,068.

Most of these sign and sign stand systems include a separate sign and a separate sign stand, both which must be disassembled, collapsed, and folded or rolled up into storage positions for transport and storage. One system which attempts to combine a sign and sign stand into a single portable collapsible unit is shown in U.S. Pat. No. 4,694,601.

SUMMARY OF THE INVENTION

It is an object of the present invention to provide an improved portable collapsible sign and sign stand system. It is another object of the present invention to provide a sign and sign stand system which has a collapsible sign panel connected to a collapsible cross-brace system which, in turn, is connected to a foldable sign stand member.

It is a further object of the present invention to provide a combination sign and sign stand system which is easy to set up and use in temporary traffic control situations. It is a still further object of the present invention to provide a combination sign and sign stand system which is easy to set up and use and also is durable and wind-resistant.

It is still another object of the present invention to provide a portable collapsible combination sign and sign stand system which has a sign panel which can be completely removed and changed for presentation of different warning and notice messages. It is still another object of the present invention to provide a portable collapsible combination sign and sign stand system which has a set of warning flags integral therewith and which are easily displayable.

These and other objects and purposes of the present invention are met by the present invention which is set forth in the following written description, drawings, and claims. The invention includes a base mechanism which has a plurality of ground-engaging legs, a resilient mechanism, and an upright attached to the resilient mechanism. The leg members are preferably pivoted so they can be folded up substantially parallel with the upright member for storage. The resilient member is preferably a pair of coil springs. The upright member is preferably an extrusion member which has one or more elongated channels in it. A central bracket member is secured to the upper end of the upright member. A plurality of cross-brace members are pivotally or slidably connected to the central bracket member and, when displayed, used to hold a flexible sign panel in place. The sign panel is connected at one of its corners to the upright member, and connected at the other corners to the outer ends of the cross-brace members. Two of the cross-brace members are pivotally connected to the central bracket and can be rotated to positions substantially parallel to the upright member for storage. Another cross-brace member is slidably received in one of the channels in the upright member and held in place by a spring-mounted pin member.

Preferably, the sign panel is connected to the ends of the cross-brace members by stretchable elastic strap members which keep the sign panel taut and under tension in all weather conditions. The sign panel is also connected to the central bracket member by a detachable fastening mechanism. A plurality of warning flag members are connected to the vertical upright cross-brace member. The flag members are pivotally connected to the cross-brace so they can be deployed for display during use and then collapsed to a position parallel to the cross-brace member for storage and transport.

For storage, the horizontal cross-brace members are pivoted to a position substantially parallel to the upright member, the vertical cross-brace member is slid into the channel of the upright member, the sign panel is rolled around the collapsed cross-brace frame structure, and the legs of the sign stand are pivoted upwardly around the rolled up sign panel. A strap member is used to help securely hold the collapsed combination sign and sign stand assembly in the collapsed position.

With the present invention, a portable collapsible combination sign and sign stand mechanism is provided which is easy to set up for use in traffic control matters and the like and which also is easy to disassemble and return to its storage position. In particular, the foldable cross-brace sign frame and collapsible sign panel allow for easy and fast breakdown and set up of the unit when needed. For use, the legs are deployed to their extended positions and the sign panel is deployed to its display position in quick and easy manners. For storage, the sign frame and sign panel are quickly broken down and rolled up and the legs are folded into a compact package.

With the present invention, a sturdy wind-resistant collapsible portable sign and sign stand system is provided. The spring mechanism allows the sign to be used in all types of windy conditions without being blown over or moved to a non-desirable position. The combination sign and sign stand structure is rugged and durable in order to withstand rough handling and weather conditions over long periods of time. The flag members are pivotally attached directly to the combination sign and sign stand mechanism so that they can be rotated between their deployed and storage positions in a quick and easy manner and are always a part of the entire system.

Other objects, features, benefits, and advantages of the present invention will become apparent from the following description of the invention, when taken in conjunction with the accompanying drawings and appended claims.

BEST MODE(S) FOR CARRYING OUT THE INVENTION

Figure 1:
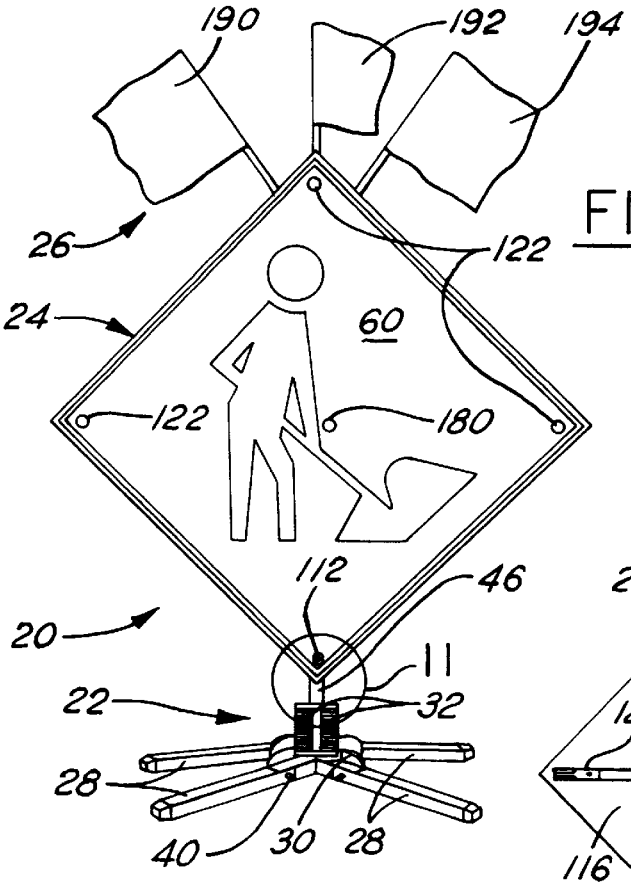
FIG. 1 illustrates the present invention in the display position.
Figure 2:
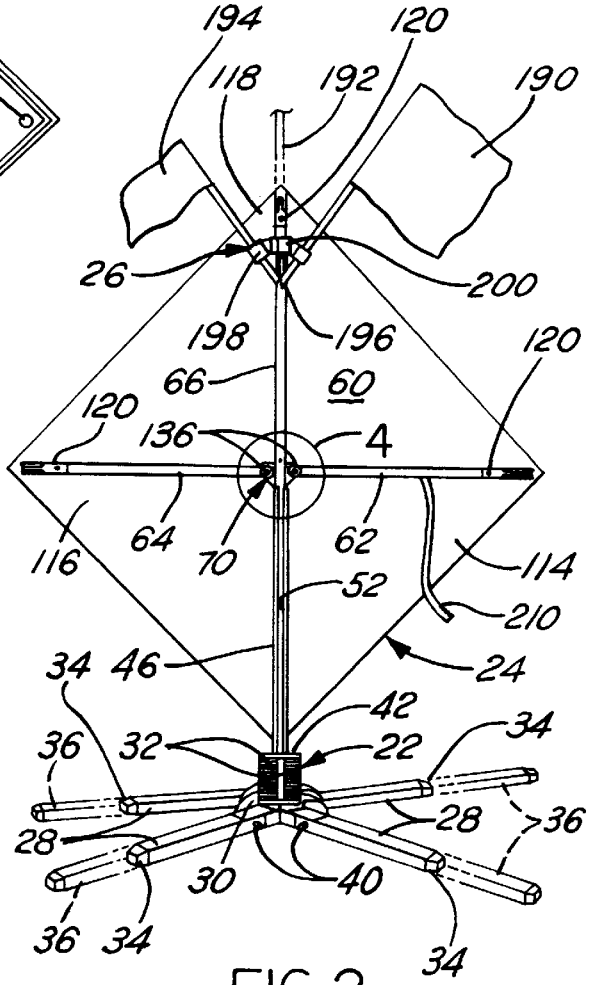
FIG. 2 is a rear view of the present invention in the display position.
Figure 3:
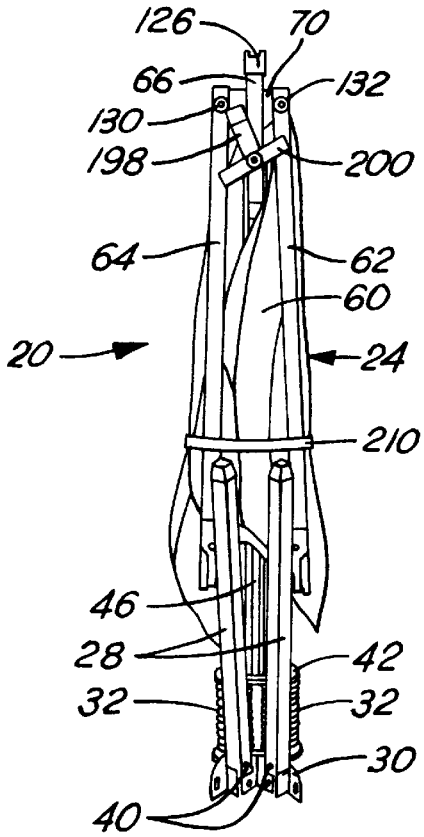
FIG. 3 illustrates the present invention in the folded up and storage position.
Figure 4:
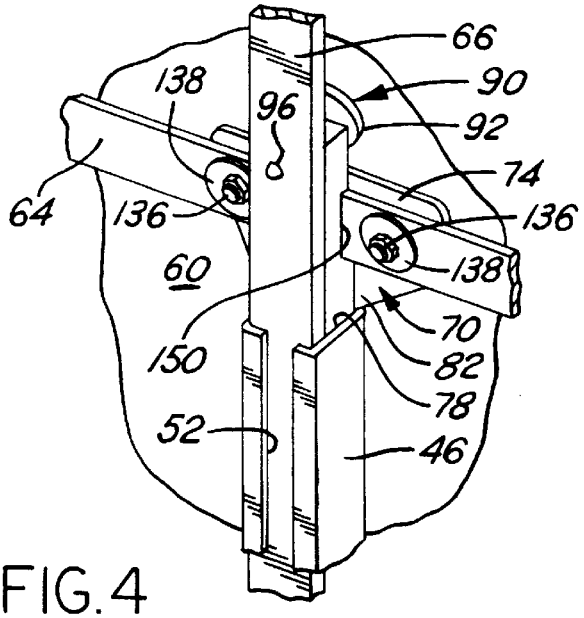
FIG. 4 is a close-up view highlighting the intersection between the central bracket member, vertical upright member, and cross-brace members.

The preferred embodiment of the present invention is shown in FIGS. 1–17. The present invention is a portable collapsible combination sign and sign stand device and is generally referred to by the numeral 20 in the drawings. In this regard, FIGS. 1 and 2 show the invention in the deployed or display condition, while FIG. 3 shows the invention in the folded-up and collapsed condition ready for transport and storage. The remaining FIGS. 4–17 illustrate various features and details of the present invention, as well as the manner in which the invention is assembled for display and disassembled or broken down for storage.

The present invention 20 generally comprises a base member 22 and a sign member 24. A flag mechanism or assembly 26 is also preferably included as part of the present invention. It is understood, however, that, the invention 20 can include only the base member 22 and sign member 24 without an accompanying flag mechanism 26.

The base member 22 includes a plurality of elongated ground-engaging leg members 28, a base bracket member 30 and a pair of coil springs 32. The leg members 28 are made of aluminum tubing and are telescopic. As shown in FIG. 2, the legs have end cap members 34 attached to telescopic tubular inner members 36 which are slidingly received inside the outer tubular leg members 28. When the combination sign and sign stand mechanism 20 is assembled and deployed for use, the leg members are preferably in their elongated extended positions. This provides the largest "footprint" for stability of the sign stand device. When the assembly 20 is folded-up for storage and transport, as shown in FIG. 3, the leg members 28 are in their telescopic or shortest conditions. As shown by a comparison of FIGS. 2 and 3, leg members 28 are pivotally connected to the base bracket member 30 by a plurality of releasable pivot or pin members 40, which are spring-activated and conventionally known in the art. It is also preferred in accordance with the present invention that the leg members be provided with "kick-release" unlatching mechanisms (not shown), such as those disclosed in U.S. Pat. No. 5,340,068 (owned by a common assignee) the disclosure of which is hereby incorporated herein by reference.

Figure 11:
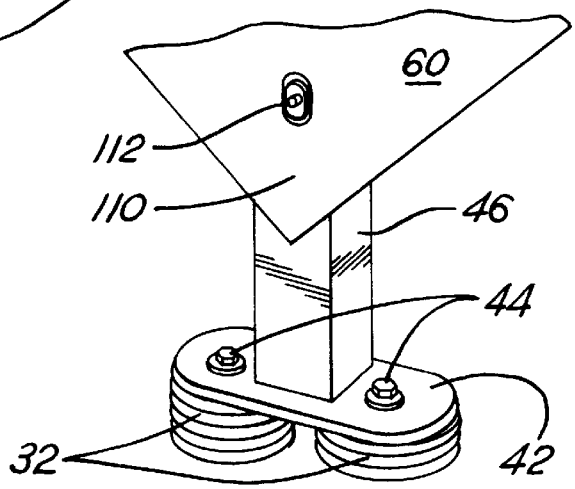
FIG. 11 illustrates the preferred manner in which the sign panel is connected to the vertical upright member.
Figure 13:
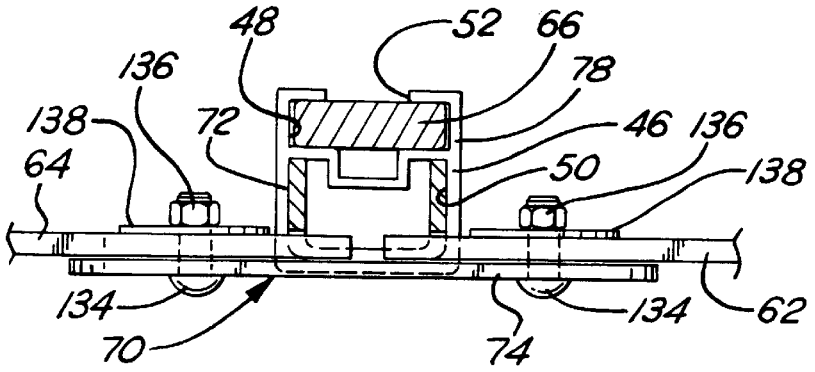
FIGS. 13 and 14 are cross-sectional views of the central bracket member, the views being taken along lines 13—13 and 14—14, respectively, in FIG. 12 and in the direction of the arrows.

A bracket member 42 is attached by conventional fasteners such as bolts 44 to the upper ends of the vertically-positioned coil-springs 32. (This is best shown in FIG. 11.) Vertical upright member 46 is also connected, such as by welding, to bracket member 42. The vertical upright member 46 is preferably made from extruded aluminum and preferably has two cross-sectional size and shape as shown in the drawings. As particularly shown in FIG. 13, the upright member 46 has a first channel 48 and a second channel 50. Channel 48 is adapted to hold the vertical cross-brace member of the sign frame, as discussed below, and also has an open elongated slot 52 along the length thereof. The slot 52 allows the holder bracket 198 and the attachment fastener 196 for the flag mechanism 26, as discussed in more detail below, to travel along the vertical upright member 46 when the vertical cross-brace member is raised and lowered between its stored position and its deployed position. In this regard, if a flag mechanism 26 is not provided or utilized with the sign and sign stand assembly 20, then it is possible, in an alternate embodiment, to provide a completely enclosed channel 48 in the vertical upright member 46.

Figure 16:
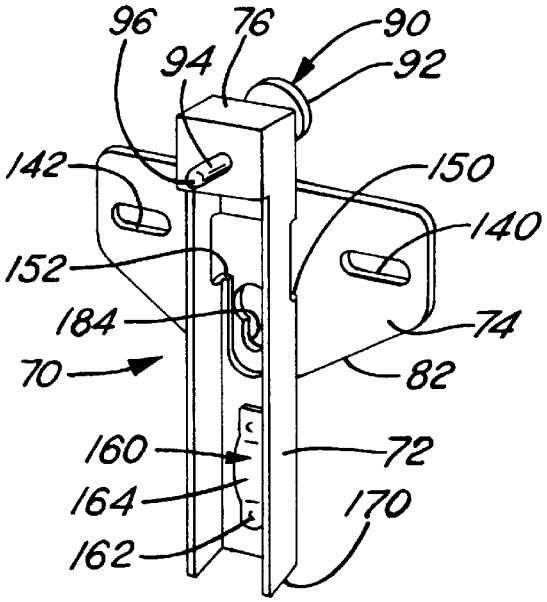
FIG. 16 is a perspective view illustrating the central bracket member.

The sign member 24 includes a sign panel 60, a first horizontal cross-brace member 62, a second horizontal cross-brace member 64, and a vertical cross-brace member 66. The two horizontal cross-brace members 62 and 64 are pivotally attached to a central bracket member 70. The bracket member 70 is shown in perspective view in FIG. 16, in three elevational views in FIGS. 12, 13 and 14, and attached to cross-brace members 62 and 64 in FIGS. 2–9. As best shown in FIG. 16, the central bracket member 70 includes a U-shaped channel member 72, a flat connector plate member 74, and a semi-enclosed pin-housing 76.

In use, the central bracket member 70 is positioned on the upper end 78 of the vertical upright 46. The U-shaped channel member 72 of the bracket member 70 slides within channel 50 of the vertical upright 46 and the lower edges 82 of the plate member 74 rest on the upper end 78 of the vertical upright.

Figure 14:
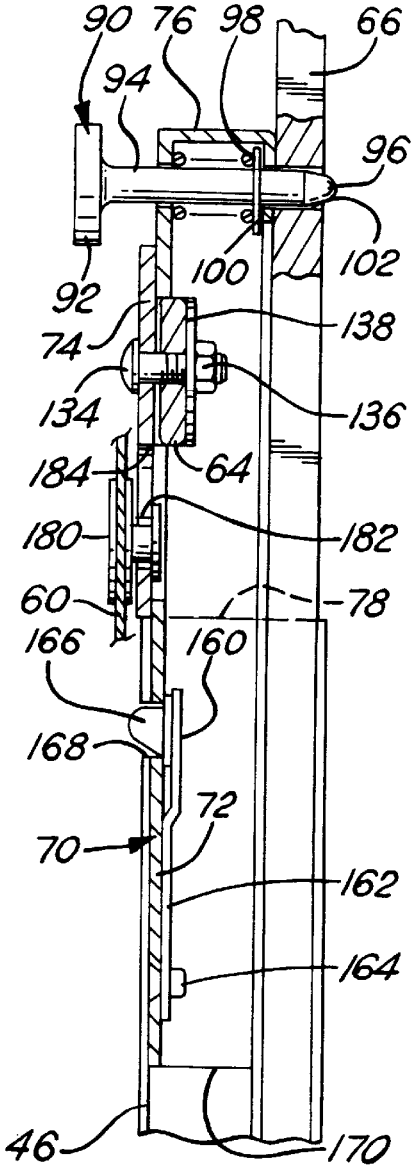
Figure 17:
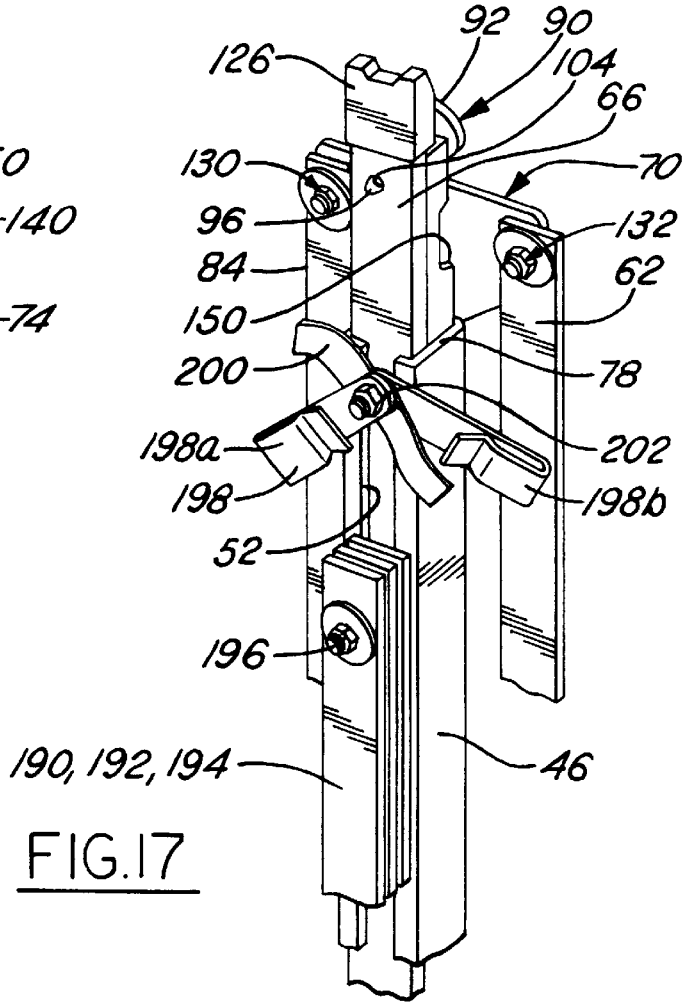
FIG. 17 is an enlarged view showing a portion of the combination sign and sign stand assembly in the folded-up and collapsed condition.

A spring-biased pin member 90 is positioned in the housing 76 of the bracket member 70. The pin member 90 has an enlarged head 92 (so it can be manually grasped by an operator) and an elongated pin member 94. The end 96 of the pin member 94 is preferably tapered, as shown in FIGS. 14, 16 and 17, so that the pin member will more readily mate with one of the openings (102, 104) in the vertical cross-brace member 66. The pin member 90 is spring-biased by coil spring 98 and held in place in the pin-housing 76 by a conventional lock ring 100.

Figure 7:
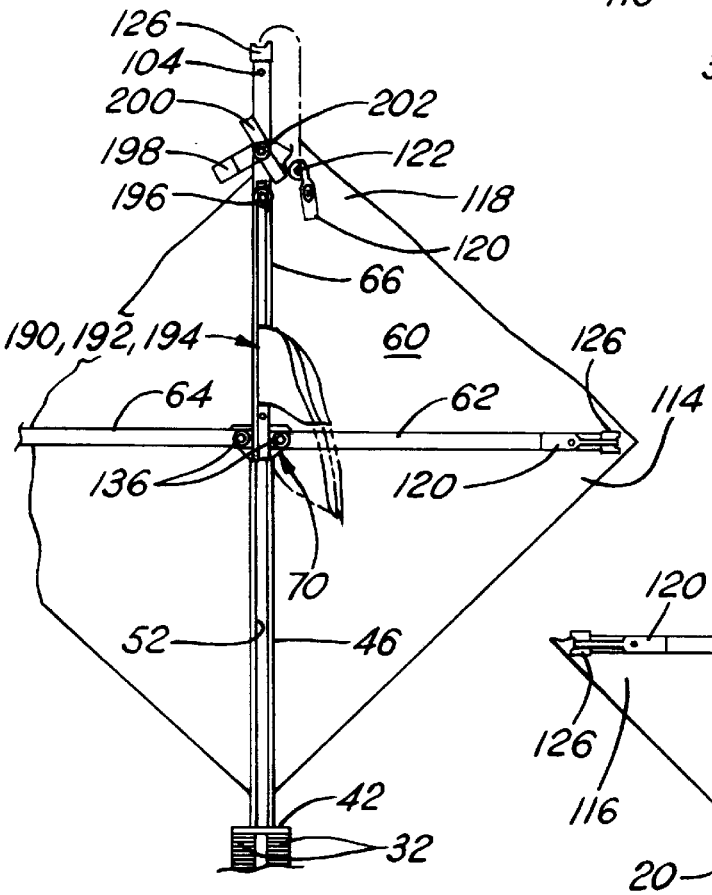
Figure 8:
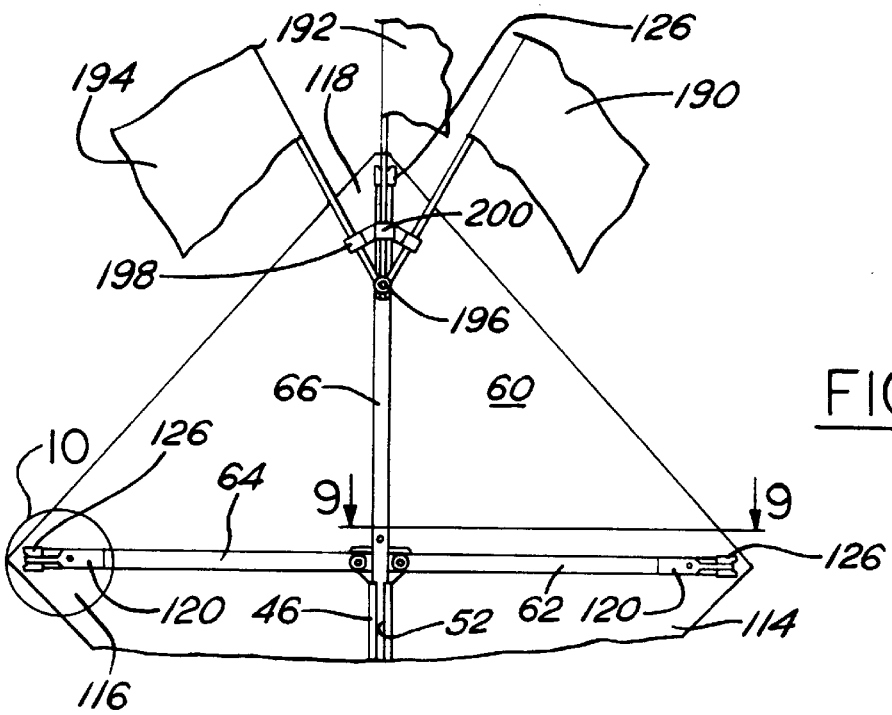

As indicated above, the vertical cross-member 66 is slidably positioned in elongated channel 48 in the vertical upright 46. The vertical cross-brace member 66 includes a number of openings which are positioned in line with the pin member 90 so that the vertical cross-brace can be held securely in place at desired positions on the sign assembly 20 (and also so other sizes of sign members could be used). In this regard, opening 102 is provided in the vertical cross-brace member 66 so that the vertical cross-brace member can be held in its uppermost deployed position (as shown in FIGS. 2, 7 and 8). Another opening 104 is positioned near the upper end of the vertical cross-brace 66, as shown in FIG. 17, and used to hold the pin member 90 when the cross-brace member 66 is in its stored position inside the vertical upright 46. (The stored position is also shown in FIG. 3.) In FIG. 17, the sign stand assembly is shown with the sign panel 60 removed for clarity.

The lower end 110 of the sign panel 60 is held in place on the vertical upright member 46 by a snap-tab fastener 112. This is particularly shown in FIG. 11. The fastener 112 can be of any conventional type, but preferably is a snap-tab fastener with the male member being positioned on the vertical upright member 46 and the female member being secured to the end 110 of the sign panel 60. With the snap-tab fastener, the sign panel 60 can be completely removed from the sign frame and assembly 20, as discussed in more detail below. This allows change of the sign panel if another notice or warning label is desired for the sign member 24.

The present invention can be used with sign panels 60 of any conventional size, such as 48 inch by 48 inch or 36 inch by 36 inch. For this purpose, another snap-tab post (not shown) is preferably positioned adjacent the snap-tab post utilized with fastener 112 so that sign panels of difference sizes can be utilized.

The remaining three corners or ends 114, 116, 118 of the sign panel 60 are held in place on the ends of the cross-brace members 62, 64 and 66, respectively, by stretchable elastic fasteners 120. Fasteners 120 are particularly shown in FIG. 10. The fasteners 120 are preferably the same for all three corners 114, 116 and 118 and preferably are the Duralatch fasteners marketed by Marketing Displays, Inc., Farmington Hills, Mich. One end of the each of the fasteners 120 is attached to the sign panel by rivets 122 (see FIGS. 1 and 7) and are adapted to wrap around the ends of the cross-braces and be held thereon by snap-tab fasteners 124. In this regard, the snap-tab fasteners 124 can be the same as snap-tab fasteners 112 used for the end or corner 110 of the sign panel. Molded cap members 126 are positioned on the ends of each of the cross-brace members 62, 64 and 66, respectively, in order to position the fasteners 120 thereon and allow the elastic material to be stretched around the ends of the cross-braces without damage thereto.

Figure 9:
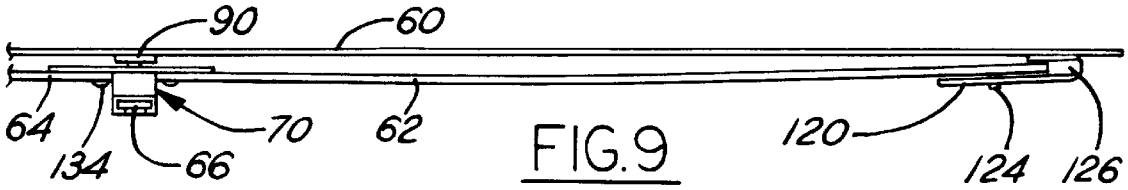
FIG. 9 is a cross-sectional view of the invention as shown in FIG. 8, with the cross-section being taken along line 9—9 and in the direction of the arrows.
Figure 10:
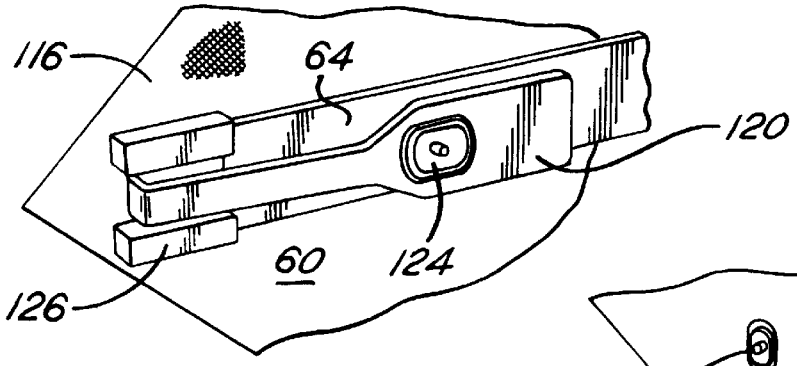
FIG. 10 is a close-up of the preferred manner in which the sign panel is connected to the end of the cross-brace members.

The stretchable elastic fasteners 120 apply a constant tension to the sign panel 60 and keep it taut on the sign frame. Also, fasteners 120 automatically compensate for temperature variations, that is, the stretchable members accommodate expansion and shrinkage of the sign panel member in hot and cold weather and still keep the face of the sign panel taut and the legend thereon visible to passing motorists and pedestrians in all weather conditions. In this regard, as shown in FIG. 9, the tension in the sign panel 60 caused by the elastic fasteners 120 cause the horizontal cross-brace members, such as member 62, to be bowed slightly. Similarly, vertical cross-brace member 66 may be bowed slightly for the same reasons.

The two horizontal cross-brace members 62 and 64 are connected to the plate member 74 on the central bracket member 70 by a pair of fasteners 130 and 132, respectively. The fasteners 130, 132 are preferably a bolt, nut and washer combination, such as that shown in FIGS. 13 and 14, with the bolts, nuts and washers being indicated by the numerals 134, 136 and 138, respectively.

The fasteners 130 and 132 are positioned in elongated slots 140 and 142, respectively, in the plate member 74. The slots 140 and 142 allow the fasteners to slide when the cross-brace members 62 and 64 are moved from their folded and stored positions, as shown in FIGS. 3 and 17, to their deployed and locked positions, as shown, for example, in FIGS. 2 and 4.

A pair of slots or openings 150 and 152 are provided in the U-shaped channel member 72 of the central bracket 70. These are best shown in FIG. 16. When the combination sign and sign stand assembly 20 is deployed in the display position, ends 63 and 65 of the horizontal cross-braces 62 and 64, respectively, are positioned and locked in the openings 150 and 152, respectively. (See FIGS. 4 and 12.)

When the assembly 20 is in its stored and folded-up position (FIGS. 3 and 17), the fasteners 130 and 132 are positioned in their respective slots 140 and 142 toward the outer edges of the plate member 74. However, when the sign member 24 is assembled to its display position, the tautness of the sign panel caused by the elastic straps 120 connecting the sign panel 60 to the ends of the cross-brace members cause the cross-brace members 62 and 64 to slide to the opposite ends of the slots 140 and 142 such that the ends 63 and 65 of the cross-brace members are inserted into the openings 150 and 152. In this manner, the horizontal cross-brace members 62 and 64 are releasably "locked" in their deployed or display positions; the force caused by the stretchable straps 120 keeps the horizontal cross-braces 62 and 64 in that position. The ends of the horizontal cross-braces can only be removed from the openings 150 and 152 by application of sufficient manual force to overcome the force caused by the elastic strap members 120 on the sign panel 60.

Figure 12:
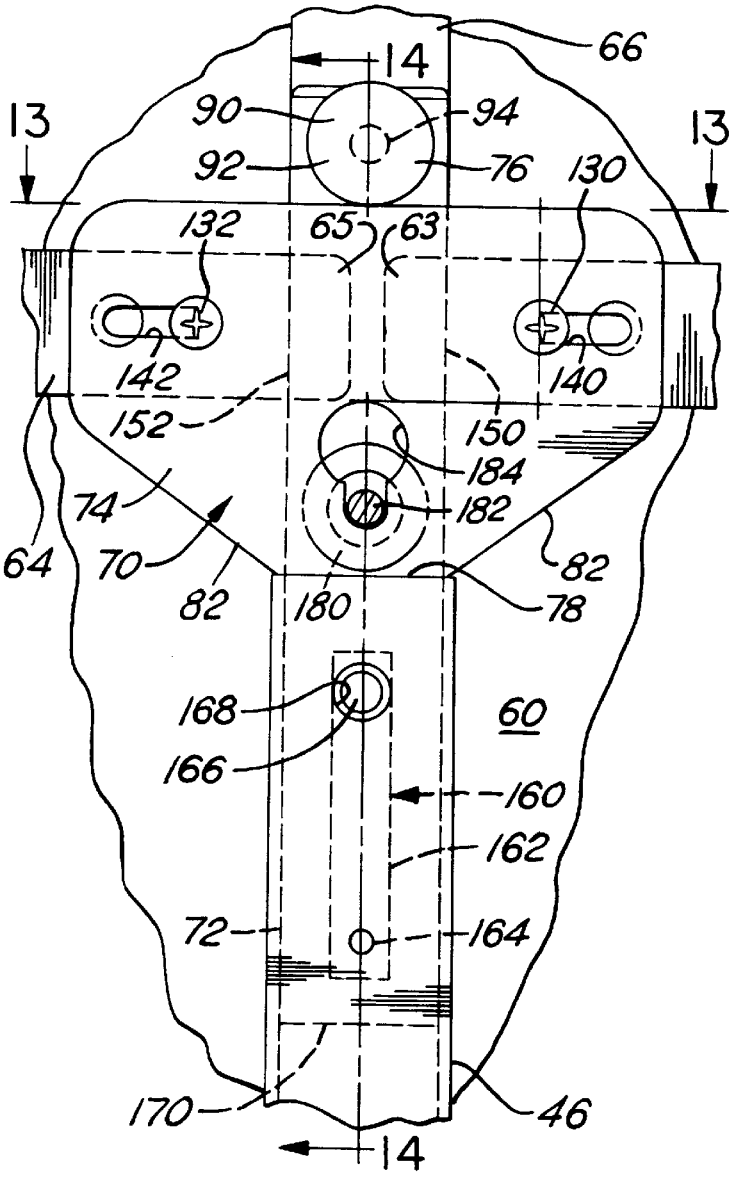
FIG. 12 is an elevational view showing the central bracket member for use with the present invention.

The central bracket member 70 is adapted to be removably inserted in the end 78 of the vertical upright member 46. In this manner, additional central bracket members with vertical and horizontal cross-braces of different lengths can be utilized with the sign stand (base member 22 and upright member 46). For this purpose, the central bracket member 70 is releasably secured in the upper end of the upright member 46 by spring mounted detent mechanism 160. This mechanism is shown in FIGS. 12, 14 and 16. The mechanism 160 includes a leaf spring member 162 which is secured at one end to the vertical upright member 46 by a pop rivet or other fastener 164. The other end of the leaf spring member 162 has a nub or projection 166 which is adapted to fit within hole or opening 168 in the upright member 46.

In order to release bracket member 70 from the upright member 46, the nub or projection 166 is manually pushed or moved toward the inside of the upright member. In this manner, the central bracket, together with the horizontal cross-braces, can be disassembled from the sign stand. Reattachment of the central bracket member to the vertical upright 46 is accomplished in the reverse manner, that is, by merely inserting the lower end 170 of the bracket member 70 into the channel 50 in the vertical upright until the spring activated nub 166 protrudes through the opening 168.

Figure 15:
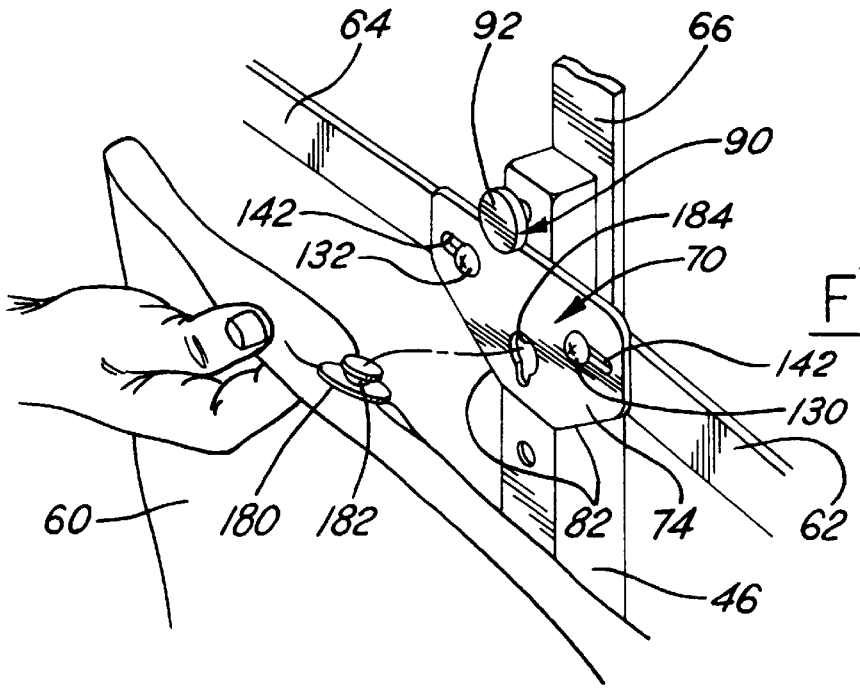
FIG. 15 illustrates the preferred manner in which the sign panel is connected to the central bracket member.

The central part of the sign panel 60 is also secured to the central bracket member 70. This prevents the central part of the sign panel from sagging or falling, particularly when the combination sign and sign stand assembly is being assembled or deployed into its display position. For this purpose, a fastening member, such as a button 180, is secured to the sign panel 60. The member 180 is shown in FIGS. 1 and 15. The button 180 has an annular recessed slot 182 which mates with the keyhole slot 184 provided in the plate 74 of the central bracket member 70. This is shown in FIGS. 12 and 14.

The flag assembly 26 includes a plurality (preferably three) of individual flag members 190, 192 and 194. The flag members each comprise a short flat flag stick and a flexible flag panel and are pivotally mounted to the vertical cross-brace member 66 by pivot pin or mechanism 196.

When the flag members 190, 192 and 194 are in their stored position, they are rotated to a position substantially parallel to the vertical upright member 46. This is shown in FIGS. 5–7 and 17. When the flag members 190, 192 and 194 are positioned in their assembled display positions, they are rotated to the positions shown in FIGS. 2 and 8. In this regard, two of the flag members are held in place by flag bracket mechanism 198 while the third flag member is held in its vertical upright position by a Velcro strap or other similar fastening member 200 which is connected to the vertical cross-brace member 66. The Velcro strap 200 and flag bracket 198 are attached to the vertical cross-brace member 66 by a conventional fastening member 202, such as a nut and bolt.

In order for the three flag members 190, 192 and 194, as well as the sign holder bracket 198, to slide in the elongated slot 52 in the vertical upright member 46, appropriate spacers (not shown) are provided between the flag members and the holder bracket, and the vertical cross-brace 66. The sign holder bracket 98 is preferably comprised of two separate holder members 198*a* and 198*b*, as shown in FIG. 17, so that the flag members can be positioned at various angles on top of the sign assembly 20, and also so that the bracket sign holder member 198 can be rotated to a basically vertical position to accommodate folding up and storage of the sign assembly 20, as shown in FIG. 3.

An alternative way to provide and deploy sets of warning flags is shown in U.S. Pat. No. 4,619,220 (owned by the same assignee), the disclosure of which is hereby incorporated by reference herein.

As indicated above, a representative illustration of the inventive combination sign and sign stand assembly 20 in the folded-up and stored position is shown in FIG. 3. In this configuration, a strap or fastener member 210 is provided in order to wrap around the assembly 20 and hold the sign panel 60 and sign frame in place. The strap 210 is preferably permanently connected to one of the horizontal cross-brace members or the sign panel itself at an appropriate position so that it cannot be misplaced. It is also possible to hold the sign panel and folded sign frame in position merely by use of the leg members 28, that is, by rotating them up to their folded positions, as shown in FIG. 3.

Figure 5:
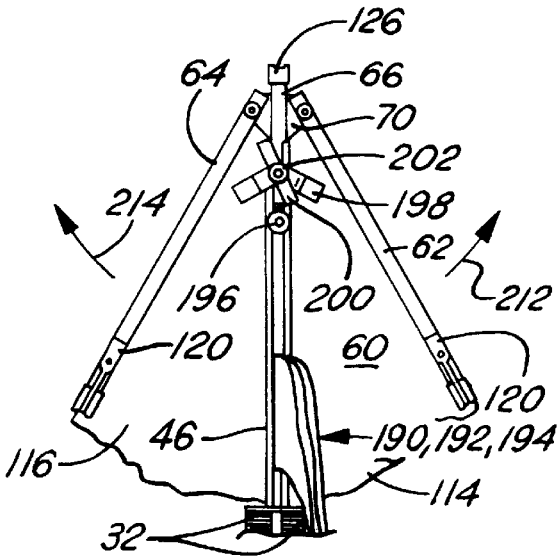
FIGS. 5, 6, 7 and 8 illustrate various steps in the assembly and set up of the present invention from the stored position to the display position.
Figure 6:
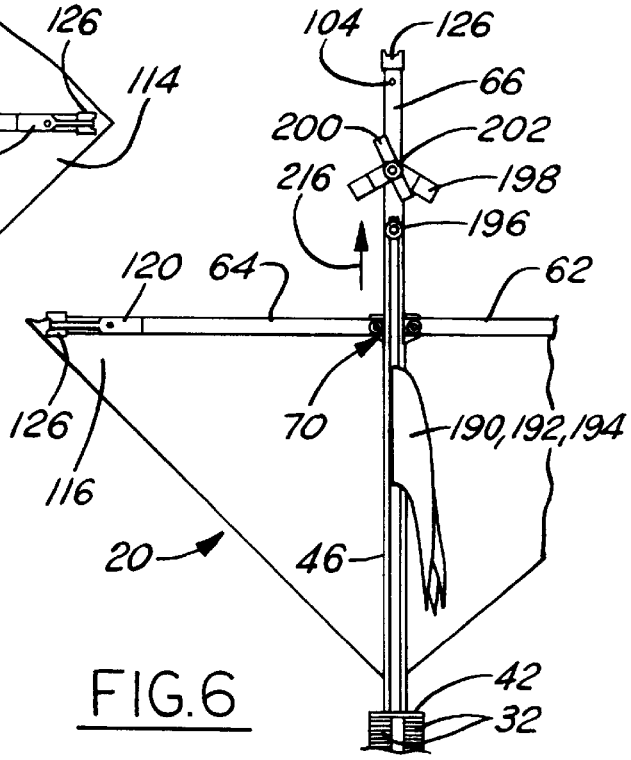

In order to deploy the sign and sign stand assembly 20 from the stored position shown in FIG. 3 to the display position shown in FIGS. 1 and 2, the strap 210 is first removed and the legs 28 folded down to their ground engaging positions. The telescopic inner leg members 36 can also be deployed at this stage. Thereafter, as shown in FIG. 5, the two horizontal cross-brace members 62 and 64 are rotated from their stored positions to their display positions. This is shown in FIGS. 5 and 6 where the movement of the cross-brace members 62 and 64 is depicted by arrows 212 and 214, respectively. In this regard, as noted in the drawings, it is not necessary to remove the sign panel 60 from the cross-brace members 62 and 64 in order to store the assembly 20. Thus, as shown in FIG. 5, the elastic strap members 120 are used to hold the sign panel 60 to the cross-brace members 62 and 64 at all times. Also, this means that when the horizontal cross-brace members 62 and 64 assume their horizontal positions, as shown in FIG. 6, the tension in the sign panel caused by the elastic strap members 120 help force the inner end 63 and 65 of the cross-brace members into the slotted openings 150 and 152 in the central bracket 70, thereby holding the horizontal cross-brace members securely in their display positions.

Also, as is evident from the above discussion, the lower end 110 of the sign panel 60 does not have to be removed or reattached from the vertical upright member 46 in order to store or deploy the combination sign and sign stand assembly 20.

Once the assembly 20 is in the position shown in FIG. 6, the vertical cross-brace member 66 is moved to its display position. This is accomplished by manually releasing pin 90 from the opening 102 in the cross-brace member 66 and then manually pulling up the cross-brace member 66 in the direction of arrow 216. Once the vertical cross-brace member 66 is locked in its full upright position, the strap member 120 on the upper edge 118 of the sign panel 60 is wrapped around the upper end of the vertical cross-brace member 66 and secured in place by the appropriate snap-tab fastening mechanism.

Finally, in order to finish the deployment of the sign stand assembly 20, the flag holder bracket 198 is rotated to its horizontal chevron-shaped position and the three flag members 190, 192 and 194 are rotated from the position shown in FIG. 7 to the position shown in FIG. 8. The two outer flag members 190 and 194 are secured in place in the holder bracket 198 while the central flag member 192 is held in place by the Velcro strap 200.

In order to fold-up and return the assembly 20 to its storage position, the steps as indicated above are simply reversed. First, the flags are detached from the holder bracket 198 and Velcro fastening strap 200 and rotated to their stored positions parallel to the vertical upright 46. Thereafter, the edge 118 of the sign panel 60 is released from the vertical upright member 66 and the member 66 is returned to its stored position inside the vertical upright 46. At this point, the two horizontal cross-brace members 62 and 64 are manually pulled away from the vertical upright member 46 until ends 63 and 65 are released from the slotted openings 150 and 152. At this point, the cross-brace members 62 and 64 are rotated to their stored positions substantially parallel to the upright member 46. The sign panel 60 is then manually wrapped around the folded sign frame mechanism and the legs 28 of the base mechanism 22 are telescoped, and rotated to their stored positions. Strap 210 is also used to help hold the sign panel in its stored position. Preferably, the strap is made from Velcro material, although other conventional strap materials could be used, such as elastic materials.

As indicated, the deployment and disassembly of the combination sign and sign stand mechanism 20 is accomplished in a quick and easy manner with the present invention. The invention also allows ready removal and replacement of the sign panel 60. In this regard, in order to remove the sign panel 60, the strap members 120 are disconnected from the cross-brace members at corners 114, 116 and 118, corner 110 is disconnected from the lower end of the vertical upright member 46, and the fastener 180 is removed from the keyhole slot 184 in the central bracket member 70. The replacement sign panel can be reattached to the sign frame in the reverse manner.

The present invention also allows the use of different sizes of sign members 24. Each of the sign members 24 has its own set of horizontal cross-brace members, together with its own central bracket member and sign panel. The same base member 22, vertical cross-member 66, and vertical upright member 46 can be used for all of the various sizes of sign members 24.

Although the above description describes the preferred embodiment(s) of the present invention, it is obvious that modifications and changes can be made in the structure and details without departing from the spirit and scope of the present invention. For example, a base mechanism or member could be used that does not have coil springs or any other type of wind-resistant mechanism. Also, different ground engaging leg members can be utilized. Other configurations and cross-sections of the vertical upright member can also be used, together with various sizes and shapes of flag members 26. In addition, other types of fastener mechanisms could be used to connect the sign panel to the cross-brace members and vertical upright member. Different mechanisms and brackets could also be utilized to connect the flag members to the cross-brace members and display the flags for viewing by passing motorists and pedestrians.

While the best mode for carrying out the invention has been described in detail, those familiar with the art to which this invention relates will recognize various alternative designs and embodiments for practicing the invention as defined by the following claims.

What is claimed is:

1. A sign and sign stand assembly comprising:

a sign member having a sign panel, a vertical cross-brace member and a pair of horizontal cross-brace members, said panel having a planer shape when deployed in its display condition and being able to be folded up for storage;

a base member having a plurality of foldable ground-engaging leg members and a vertical upright member with a longitudinal axis, said ground-engaging members being foldable between a first ground-engaging position extending outwardly substantially transverse to said longitudinal axis and a second storage position extending substantially parallel to said longitudinal axis and adjacent to said vertical upright member;

a central bracket member attached to said vertical upright member and having a vertically extending planar surface;

said sign panel being directly attached to each of said vertical and horizontal cross-brace members and also directly attached to said vertical upright member;

said pair of horizontal cross-brace members being pivotally attached by pivot members at separate spaced locations on said planar surface of said central bracket member, said pivot members having a longitudinal axis substantially perpendicular to said planar surface, said horizontal cross-brace members being foldable between a first position substantially transverse to said longitudinal axis for display of said sign panel and a second storage position extending substantially parallel and adjacent to said vertical upright member, and said horizontal cross-brace members being pivoted between said first and second positions in a plane parallel to said planar surface; and said vertical cross-brace member non-pivotally connected to said upright member and slidable vertically relative to said upright member from a first position extending vertically upwardly from said vertical upright member for display of said sign panel and to a second position parallel and adjacent to said vertical upright member for storage of said sign and sign stand assembly;

wherein said sign member is adapted to be folded up to a collapsible storage configuration around said vertical upright member.

2. The sign and sign stand assembly of claim 1 wherein said base member further comprises a resilient member connecting said leg members to said vertical upright member, said resilient member allowing deflection of said vertical upright member relative to leg members.

3. The sign and sign stand assembly of claim 2 wherein said resilient member comprises a pair of coil springs.

4. The sign and sign stand assembly of claim 1 wherein said sign panel member is releasably attached to said central bracket member.

5. The sign and sign stand assembly of claim 1 wherein said sign panel is releasably attached to said vertical and horizontal cross-brace members by elastic strap members.

6. The sign and sign stand assembly of claim 5 wherein said elastic strap members are adapted to hold said sign panel in tension on said vertical and horizontal cross-brace members.

7. The sign and sign stand assembly of claim 1 wherein said sign panel member is further releasably attached to said vertical upright member.

8. The sign and sign stand assembly of claim 1 wherein said sign panel member is selectively removable from said assembly.

9. The sign and sign stand assembly of claim 1 wherein said central bracket member is releasably attached to said vertical upright member.

10. The sign and sign stand assembly of claim 1 wherein said central bracket member has a pair of openings in which portions of said horizontal cross-brace members are adapted to be positioned.

11. The sign and sign stand assembly of claim 10 further comprising slot means in said central bracket member for slidingly securing said pair of horizontal cross-brace members thereto.

12. The sign and sign stand assembly of claim 1 wherein said vertical upright member has a first elongated channel therein and said vertical cross-brace member is slidably received in said first elongated channel.

13. The sign and sign stand assembly of claim 1 further comprising biased release member for releasably securing said vertical cross-brace member in said slot position.

14. The sign and sign stand assembly of claim 1 further comprising a strap member attached to said sign panel for securing said sign member in said collapsible storage configuration.

15. The sign and sign stand assembly of claim 1 further comprising at least one flag member attached to said vertical cross-brace member.

16. The sign and sign stand assembly of claim 15 wherein said flag member is pivotally attached to said vertical cross-brace member and further comprising a flag holder bracket member for holding said flag member in the deployed position.

17. The sign and sign stand assembly of claim 16 wherein at least two flag members are provided and said flag holder bracket member is attached to said vertical cross-brace member.

* * * * *